US008295500B2

(12) United States Patent
Shin et al.

(10) Patent No.: US 8,295,500 B2
(45) Date of Patent: Oct. 23, 2012

(54) METHOD AND APPARATUS FOR CONTROLLING DIRECTIONAL SOUND SOURCES BASED ON LISTENING AREA

(75) Inventors: Min Cheol Shin, Daejeon (KR); Sung Q Lee, Daejeon (KR); Hye Jin Kim, Daejeon (KR); Kang Ho Park, Daejeon (KR); Jong Dae Kim, Daejeon (KR); Se Myung Wang, Gwangju (KR); Dae Sung Kim, Tongyeong (KR)

(73) Assignees: Electronics and Telecommunications Research Institute, Daejeon (KR); Gwangju Institute of Science and Technology, Gwangju (KR)

( * ) Notice: Subject to any disclaimer, the term of this patent is extended or adjusted under 35 U.S.C. 154(b) by 462 days.

(21) Appl. No.: 12/547,288

(22) Filed: Aug. 25, 2009

(65) Prior Publication Data

US 2010/0135503 A1 Jun. 3, 2010

(30) Foreign Application Priority Data

Dec. 3, 2008 (KR) ..... 10-2008-0121914
Apr. 1, 2009 (KR) ..... 10-2009-0028233

(51) Int. Cl.
*H04R 29/00* (2006.01)

(52) U.S. Cl. ..... 381/59; 381/80; 381/85; 381/304; 381/97; 381/98

(58) Field of Classification Search ..... 381/1, 5, 381/10, 17, 18, 19, 20, 22, 302, 303, 304, 381/310, 56, 58, 59, 80, 307, 85, 86, 97, 381/98, 103, 119
See application file for complete search history.

(56) References Cited

U.S. PATENT DOCUMENTS

| | | | | |
|---|---|---|---|---|
| 5,802,190 | A | 9/1998 | Ferren | |
| 5,953,432 | A | 9/1999 | Yanagawa et al. | |
| 2005/0135643 | A1 | 6/2005 | Lee et al. | |
| 2007/0025560 | A1 | 2/2007 | Asada | |
| 2009/0087000 | A1 * | 4/2009 | Ko | 381/182 |
| 2009/0141915 | A1 * | 6/2009 | Ko et al. | 381/182 |
| 2009/0154723 | A1 * | 6/2009 | Choi et al. | 381/80 |

FOREIGN PATENT DOCUMENTS

| | | | | |
|---|---|---|---|---|
| EP | 1890520 | A1 | | 2/2008 |
| JP | 2004-187300 | | | 7/2004 |
| JP | 2004187300 | A | * | 7/2004 |
| JP | 2008-227804 | A | | 9/2008 |
| JP | 2008-252625 | A | | 10/2008 |
| KR | 10-2005-0013323 | A | | 2/2005 |
| KR | 10-2005-0060789 | A | | 6/2005 |

OTHER PUBLICATIONS

Joung-Woo Choi et al., "Generation of an acoustically bright zone with an illuminated region using multiple sources", Acoustal Society of America, 2002, pp. 1695-1700, 111 (4), Center for Noise and Vibration Control (NOVIC), Department of Mechanical Engineering, Korea Advanced Institute of Science and Technology, Science Town, Taejon-shi 305-701, Korea.

* cited by examiner

*Primary Examiner* — Vivian Chin
*Assistant Examiner* — Leshui Zhang

(57) ABSTRACT

Sound can be listened to only in a listening area by maximizing a sound energy difference between a listening area and a non-listening area while maximizing sound radiation efficiency of each sound source. Accordingly, realistic sound can be provided to listeners without causing auditory disturbance to third parties, and maximal sound effects can be obtained with only minimal control.

8 Claims, 6 Drawing Sheets

METHOD AND APPARATUS FOR CONTROLLING DIRECTIONAL SOUND SOURCES BASED ON LISTENING AREA

CROSS-REFERENCE TO RELATED APPLICATION

This application claims priority to and the benefit of Korean Patent Application Nos. 10-2008-0121914, filed Dec. 3, 2008 and 10-2009-0028233, filed Apr. 1, 2009, the disclosures of which are incorporated herein by reference in their entirety.

BACKGROUND

1. Field of the Invention

The present invention relates to a method and apparatus for controlling directional sound sources based on a listening area, and more particularly, to a method and apparatus for allowing a user to listen to sound only in a listening area by maximizing a sound energy difference between a listening area and a non-listening area while maximizing sound radiation efficiency of each sound source.

2. Discussion of Related Art

Using typical speakers to output sound causes auditory disturbance to third parties due to a natural radiation characteristic of the sound. This has led to use of personal sound systems such as headphones and earphones, which do not cause substantial auditory disturbance to third parties and do protect personal privacy, but have an issue of sensory occlusivity. Accordingly, there is a need for a personal sound system capable of resolving the issue of sensory occlusivity without causing auditory disturbance to third parties.

A method for controlling a sound output direction by adjusting a delay time of a line speaker array has been disclosed. However, this method is limited in directional control because it does not consider a changing position of a listener.

To solve this problem, a sound control method capable of simultaneously forming quiet and loud areas by differentiating sound pressure levels for areas set by a listener in one sound area has been disclosed.

In the sound control method, sound energy is concentrated in an area where a user is located such that a bright sound area having a relatively higher energy density than other areas is formed, and a quiet area or a dark sound area having a relatively lower position energy is formed in the other areas.

However, strictly speaking, the sound control method is not intended to maximize the sound radiation efficiency of each sound source because sound energy of a predetermined area is formed as brightly as possible while the other area is formed as darkly as possible when each sound source has a limited size.

When a listening position of a listener is repetitively switched between two points (e.g., a sofa and a desk), sound energy must be repetitively calculated to maximize a brightness ratio between the bright area and the other area. This increases an amount of computation.

SUMMARY OF THE INVENTION

The present invention is directed to a method and apparatus for allowing a listener to listen to sound only in a listening area by maximizing a sound energy difference between a listening area and a non-listening area while maximizing sound radiation efficiency of each sound source.

One aspect of the present invention provides a method for controlling directional sound sources based on a listening area, the method including: setting a listening area and a non-listening area depending on a listening position of a listener and then selecting the number and positions of sound sources to be used for sound output; calculating a total sound energy of sound signals input to the selected sound sources and sound energies of the listening area and the non-listening area; calculating an optimal sound-source vector for minimizing a total sound energy of the sound signals input to the selected sound sources while maximizing a sound energy difference between the listening area and the non-listening area using values of the calculated sound energies; and controlling sound pressure and phase of the selected sound sources depending on the optimal sound-source vector.

Sound may be output only in the listening area by controlling the sound pressure and phase of the selected sound sources depending on the optimal sound-source vector. In particular, sound is output only in left and right ear areas of the listener by setting the left and right ear areas of the listener as the listening area and adjusting sound pressure and phase of the selected sound sources depending on an optimal sound-source vector.

Another aspect of the present invention provides an apparatus for controlling directional sound sources based on a listening area, the apparatus including: a listening/non-listening area setting unit for setting a listening area and a non-listening area depending on a listening position of a listener and selecting the number and positions of sound sources to be used for sound output; a sound energy calculator for calculating a total sound energy of sound signals input to the selected sound sources and sound energies of the listening area and the non-listening area; a sound-source vector calculator for calculating an optimal sound-source vector for minimizing a total sound energy of the sound signals input to the selected sound sources while maximizing a sound energy difference between the listening area and the non-listening area using values of the calculated sound energies; and a sound pressure and phase controller for controlling sound pressure and phase of the selected sound sources depending on the optimal sound-source vector.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF PREFERRED EMBODIMENTS

Hereinafter, exemplary embodiments of the present invention will be described in detail. However, the present invention is not limited to the embodiments disclosed below, but can be implemented in various forms. The following embodiments are described in order for this disclosure to be complete and enabling to those of ordinary skill in the art.

Figure 1:
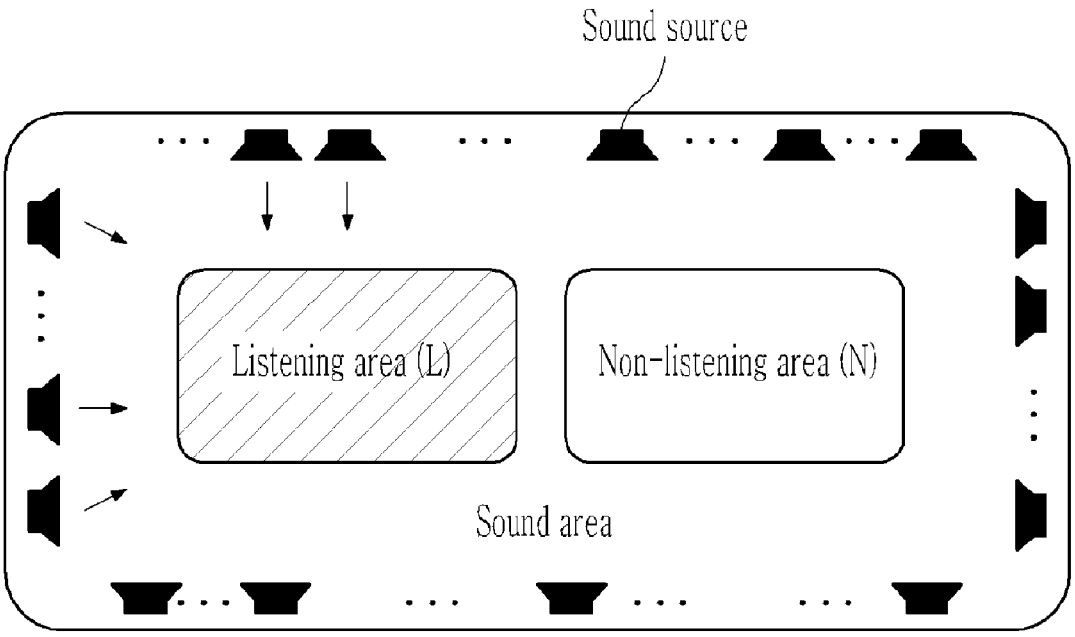
FIG. 1 illustrates a basic concept of the present invention.

FIG. 1 illustrates a basic concept of the present invention.

As shown in FIG. 1, when there are a plurality of sound sources in a sound area, a listening area L where a listener desires to listen to sound and a non-listening area N where the listener does not desire to listen to sound are set and the number and positions of sound sources to be used for sound output are selected.

Then, by properly controlling the sound pressure and phase of a sound signal input to each sound source to maximize sound radiation efficiency of the selected sound sources and a sound energy difference between the listening area L and the non-listening area N, sound is heard only in the listening area L and not in the non-listening area N.

That is, the present invention is characterized in that it allows a listener to listen to sound only in the listening area L by maximizing the sound energy difference between the listening area L and the non-listening area N while maximizing the sound radiation efficiency of each sound source, as will be described below in greater detail.

A method for calculating sound energies in the listening area L and the non-listening area N will first be described.

Figure 2A:
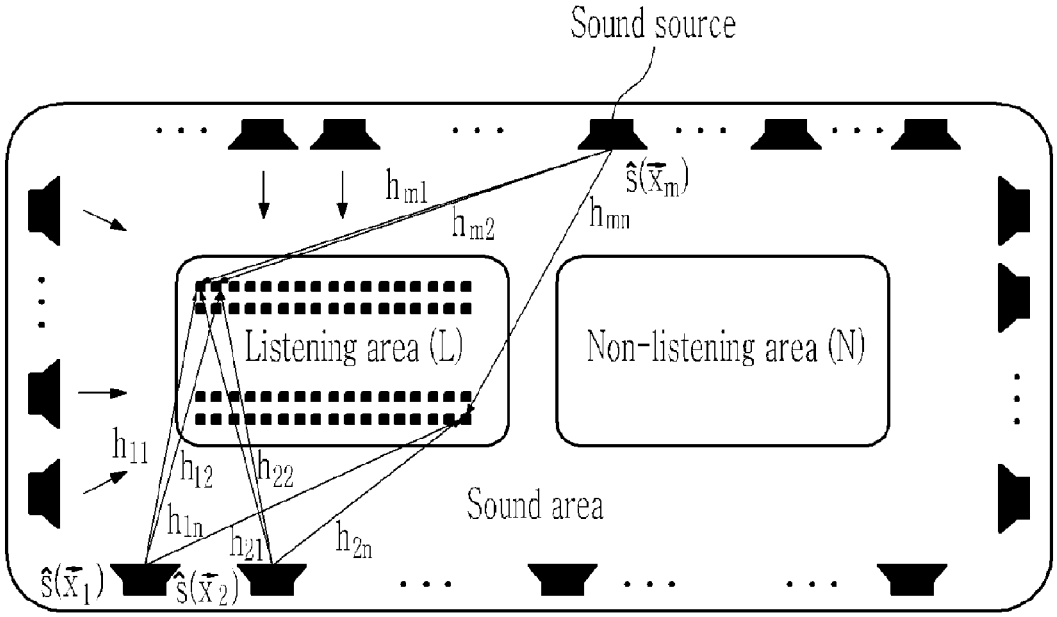
FIGS. 2*a* and 2*b* illustrate a method for calculating sound energies in a listening area and a non-listening area according to an exemplary embodiment of the present invention.
Figure 2B:
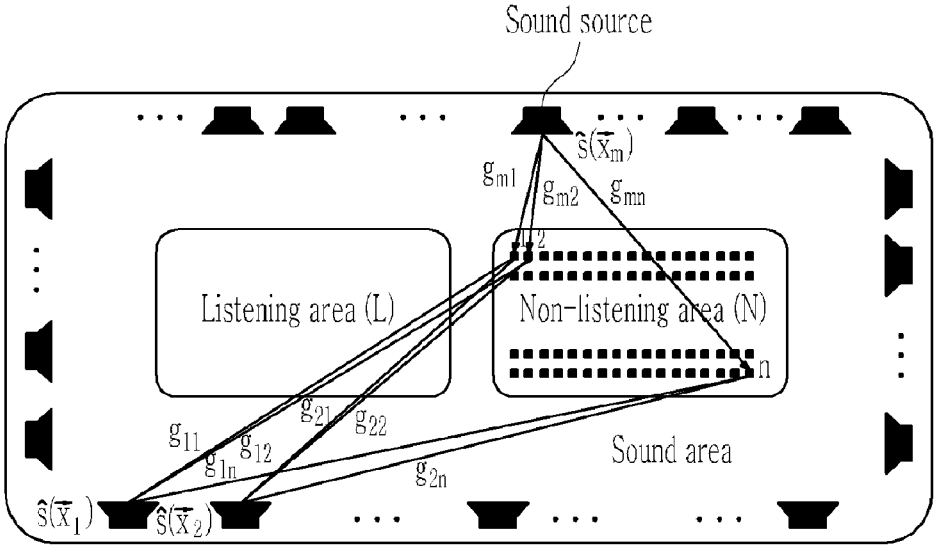

FIGS. 2*a* and 2*b* illustrate a method for calculating sound energies in the listening area L and the non-listening area N according to an exemplary embodiment of the present invention.

As shown in FIGS. 2*a* and 2*b*, it is assumed that both the listening area L and the non-listening area N consist of n points. Sound signals input to m sound sources located in an overall sound area are defined as sound-source vectors $\hat{s}(\vec{x}_1)$, $\hat{s}(\vec{x}_2)$, . . . , $\hat{s}(\vec{x}_m)$, a transfer function from an i-th sound source to the point in a j-th listening area L is defined as $h_{ij}$, and a transfer function from the i-th sound source to a point in a j-th non-listening area N is defined as $g_{ij}$. Here, $h_{ij}$ and $g_{ij}$ may be obtained through measurement and theoretical assumption of a transfer characteristic.

Here, when a position of the point in the j-th listening area L is $\vec{x}_j$, sound pressure generated by the i-th sound source at the point $\vec{x}_j$ is represented by $h_{ij}\hat{s}(\vec{x}_i)$. Likewise, sound pressure generated by the i-th sound source at a point $\vec{x}_j$ in the j-th non-listening area N is represented by $g_{ij}\hat{s}(\vec{x}_i)$.

Accordingly, a transfer function H between each sound source and the listening area L and a transfer function G between each sound source and the non-listening area N may be represented by Equation 1:

$$H = \begin{bmatrix} h_{11} & h_{21} & \dots & h_{m1} \\ h_{12} & h_{22} & \dots & h_{m2} \\ \vdots & \vdots & \ddots & \vdots \\ h_{1n} & h_{2n} & \dots & h_{mn} \end{bmatrix} \quad \text{Equation 1}$$

-continued $$G = \begin{bmatrix} g_{11} & g_{21} & \dots & g_{m1} \\ g_{12} & g_{22} & \dots & g_{m2} \\ \vdots & \vdots & \ddots & \vdots \\ g_{1n} & g_{2n} & \dots & g_{mn} \end{bmatrix}$$

The phase and sound pressure of the sound signals input to the m sound sources may be represented by a sound-source vector $S^{-}$, as shown in Equation 2:

$$s = \begin{bmatrix} \hat{s}(\vec{x}_1) \\ \hat{s}(\vec{x}_2) \\ \vdots \\ \hat{s}(\vec{x}_m) \end{bmatrix} \quad \text{Equation 2}$$

Using Equations 1 and 2, sound pressure $\hat{p}(\vec{x}_k)$ generated by each sound source at any point $\vec{x}_k$ in the listening area L may be represented by Equation 3:

$$\hat{p}(\vec{x}_k) = H_k s = [\, h_{1k} \quad h_{2k} \quad \dots \quad h_{mk} \,] \begin{bmatrix} \hat{s}(\vec{x}_1) \\ \hat{s}(\vec{x}_2) \\ \vdots \\ \hat{s}(\vec{x}_m) \end{bmatrix} \quad \text{Equation 3}$$

Likewise, pressure $\hat{p}(\vec{x}_l)$ generated by each sound source sound at any point $\vec{x}_l$ in the non-listening area N may be represented by Equation 4:

$$\hat{p}(\vec{x}_l) = G_l s = [\, g_{1l} \quad g_{2l} \quad \dots \quad g_{ml} \,] \begin{bmatrix} \hat{s}(\vec{x}_1) \\ \hat{s}(\vec{x}_2) \\ \vdots \\ \hat{s}(\vec{x}_m) \end{bmatrix} \quad \text{Equation 4}$$

Meanwhile, the sound energy E of a predetermined sound area having a volume V may be represented by Equation 5:

$$E = \frac{1}{4\rho c^2 V} \int_V \hat{p}(\vec{x})^H \hat{p}(\vec{x})\, dV \quad \text{Equation 5}$$

where ρ denotes density of a medium through which sound is propagated, c denotes a propagation speed of the sound, V denotes volume of the sound area, $\hat{p}(\vec{x})$ denotes sound pressure generated by the sound source, and H denotes a Hermitian operator.

When Equation 5 is used and the volume of the listening area L and the non-listening area N are $V_l$ and $V_n$, respectively, sound energy $E_L$ of the listening area L and sound energy $E_N$ of the non-listening area N may be represented by Equation 6:

$$E_L = \frac{1}{4\rho c^2 V_l} \int_{V_l} (H_k s)^H (H_k s)\, dV = \quad \text{Equation 6}$$

-continued $$\frac{1}{4\rho c^2}s^H\left(\frac{1}{V_l}\int_{V_l}H_k^H H_k\,dV\right)s = \frac{1}{4\rho c^2}s^H R_L s$$

$$E_N = \frac{1}{4\rho c^2 V_n}\int_{V_n}(G_l s)^H(G_l s)\,dV = \frac{1}{4\rho c^2}s^H\left(\frac{1}{V_n}\int_{V_n}G_l^H G_l\,dV\right)s = \frac{1}{4\rho c^2}s^H R_N s$$

where ρ denotes density of a medium through which sound is propagated, c denotes a propagation speed of the sound, H denotes a Hermitian operator, $V_l$ denotes the volume of the listening area, $V_n$ denotes the volume of the non-listening area, $H_k$ denotes a transfer function between the sound source and the listening area, $G_l$ denotes a transfer function between the sound source and the non-listening area, s denotes a sound-source vector, $R_L$ denotes a correlation of sound pressures formed in the volume of the listening area $V_l$ by different sound sources, and $R_N$ denotes a correlation of sound pressures formed in the volume of the non-listening area $V_n$ by different sound sources.

In Equation 6, a sound-source vector $S^-$ for maximizing a sound energy difference ($E_L$–$E_N$) between the listening area L and the non-listening area N may be obtained. However, the sound-source vector is a resultant value in which sound radiation efficiency of each sound source is not considered.

Accordingly, in the present invention, a sound energy difference $E_L$–$E_N$ between the listening area L and the non-listening area N with respect to sound energy $s^H s$ of the sound-source vector is defined as a target function γ, as shown in Equation 7, in order to maximize the sound radiation efficiency of each sound source while maximizing a sound energy difference $E_L$–$E_N$ between the listening area L and the non-listening area N.

$$\gamma = \frac{E_L - E_N}{s^H s} = \frac{1}{4\rho c^2}\frac{s^H(R_L - R_N)s}{s^H s} \approx \frac{s^H(R_L - R_N)s}{s^H s} \qquad \text{Equation 7}$$

where the sound energy $s^H s$ of the sound-source vector is obtained by squaring absolute values of complex sizes of the sound signals input to the respective sound sources and summing all the resultant values. This sound energy indicates total sound energy of sound sources used for sound output. The smaller value of the sound energy indicates higher sound radiation efficiency of each sound source.

The sound energy difference $E_L$–$E_N$ between the listening area L and the non-listening area N can be maximized with minimal sound energy by setting a sound-source vector for maximizing the target function γ as an optimal sound-source vector $S^-$ and controlling the sound pressure and phase of each sound source depending on the optimal sound-source vector $S^-$. Accordingly, the sound can be heard only in the listening area L with maximum sound radiation efficiency of each sound source.

While the sound energies of the listening area L and the non-listening area N in Equation 7 are considered with the same weight, the sound energy weight of the non-listening area N relative to the listening area L may be adjusted using a tuning parameter α, as shown in Equation 8.

$$\gamma_\alpha = \frac{s^H(R_L - \alpha R_N)s}{s^H s} \qquad \text{Equation 8}$$

It can be seen from Equation 8 that a degree of consideration of the energy difference between the two areas and a degree of consideration of the sound radiation efficiency can be properly adjusted by adjusting the sound energy weight of the non-listening area N relative to the listening area L using the tuning parameter α. That is, the tuning parameter α provides flexibility in calculating the optimal sound-source vector $S^-$.

Meanwhile, the optimal sound-source vector $S^-$ is obtained by optimizing the target function $\gamma_\alpha$ through any optimization scheme (e.g., a matrix eigenvector calculation scheme or optimization scheme). Since inverse matrix calculation is not required in calculating the optimal sound-source vector $S^-$ as shown in Equation 8, an amount of computation can be reduced, and calculation accuracy can be improved by applying a sound transfer function.

The obtained optimal sound-source vector $S^-$ is used to control the sound pressure and phase of each sound source, as described below in greater detail.

Figure 3:
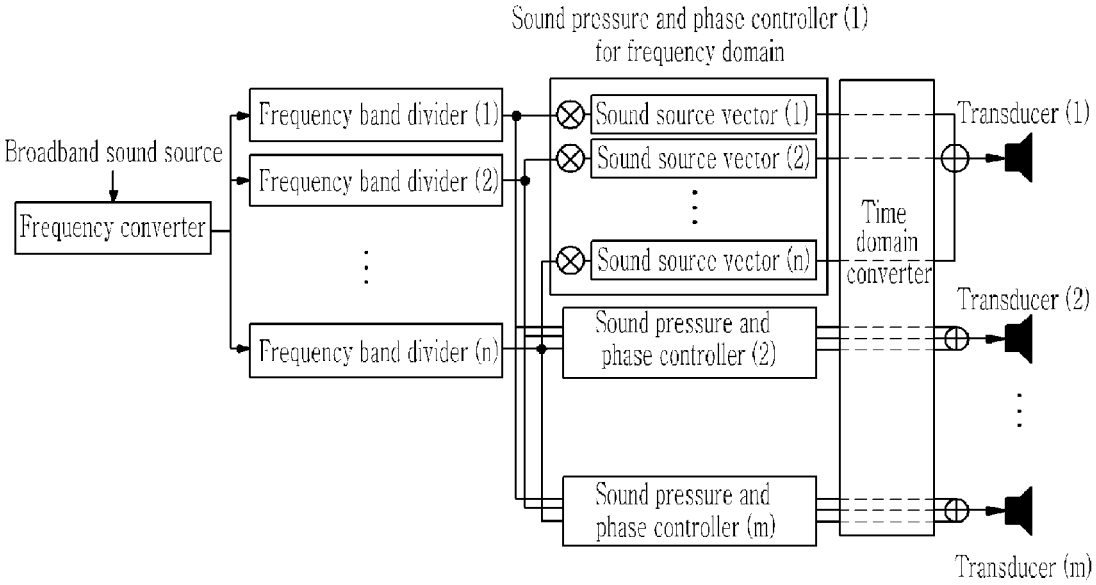
FIGS. 3 and 4 illustrate a method for controlling the sound pressure and phase of each sound source in a frequency domain and a time domain using an optimal sound-source vector.
Figure 4:
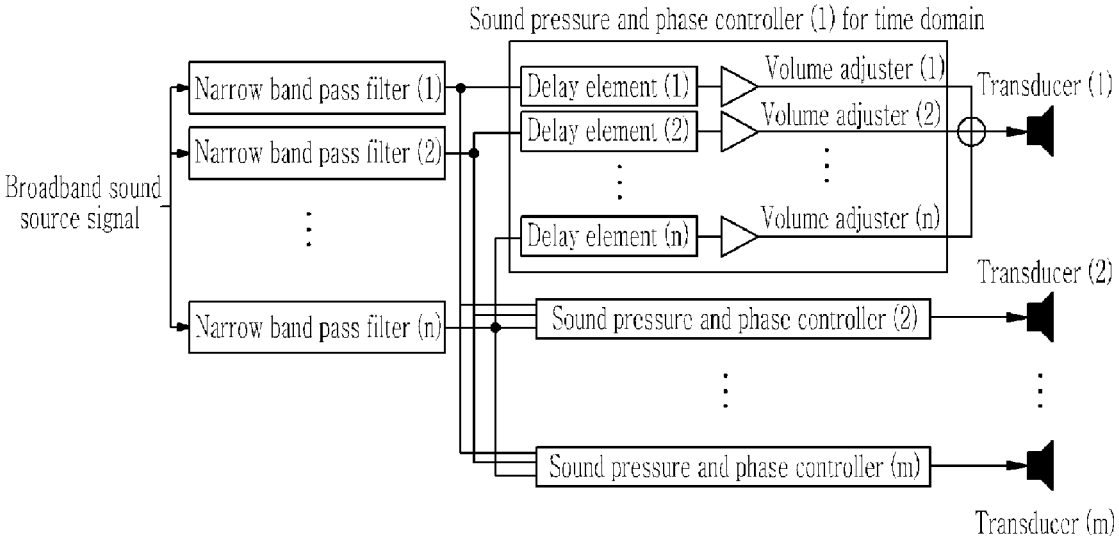
Figure 5:
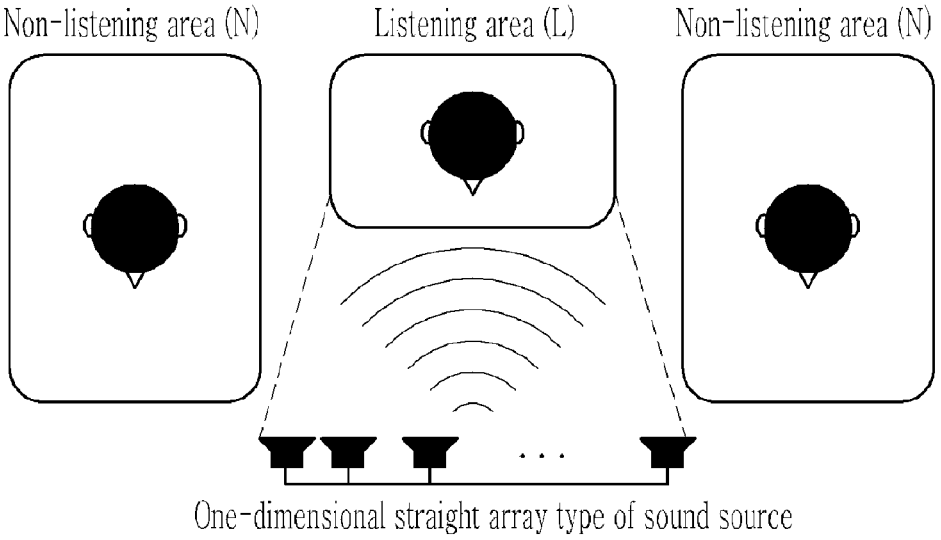
FIGS. 5 through 8 illustrate control of a one-dimensional straight array type of sound source, a one-dimensional curve array type of sound source, a two-dimensional array type of sound source, and a three-dimensional array type of sound source according to a directional sound source control method of the present invention.
Figure 6:
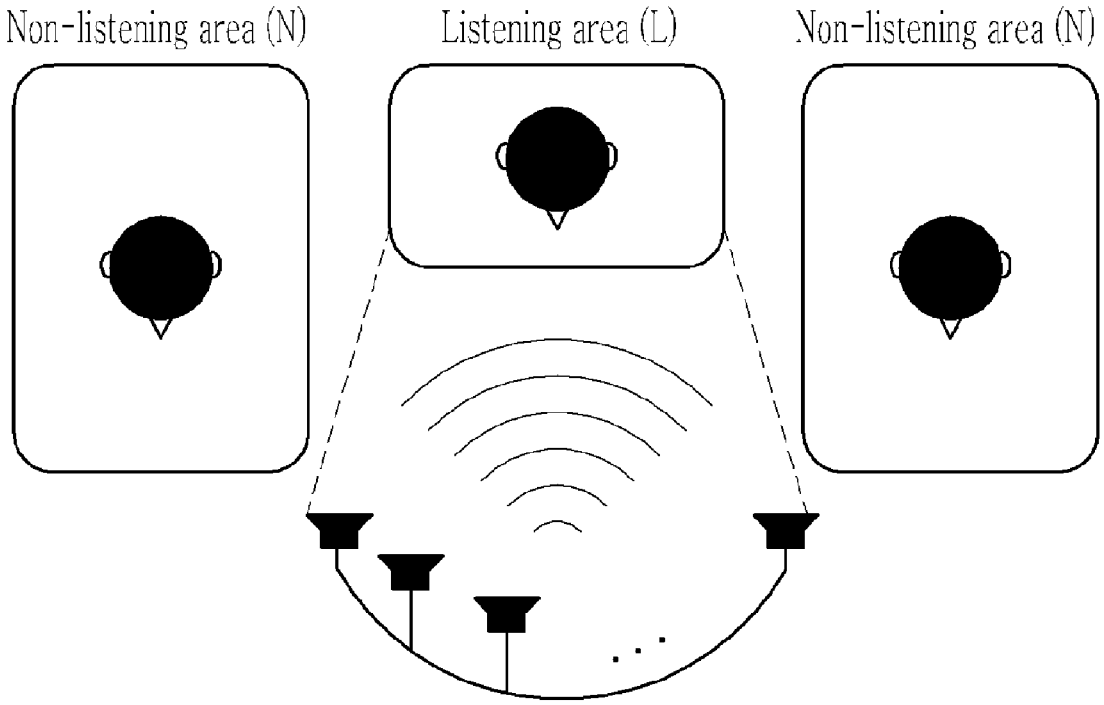
Figure 7:
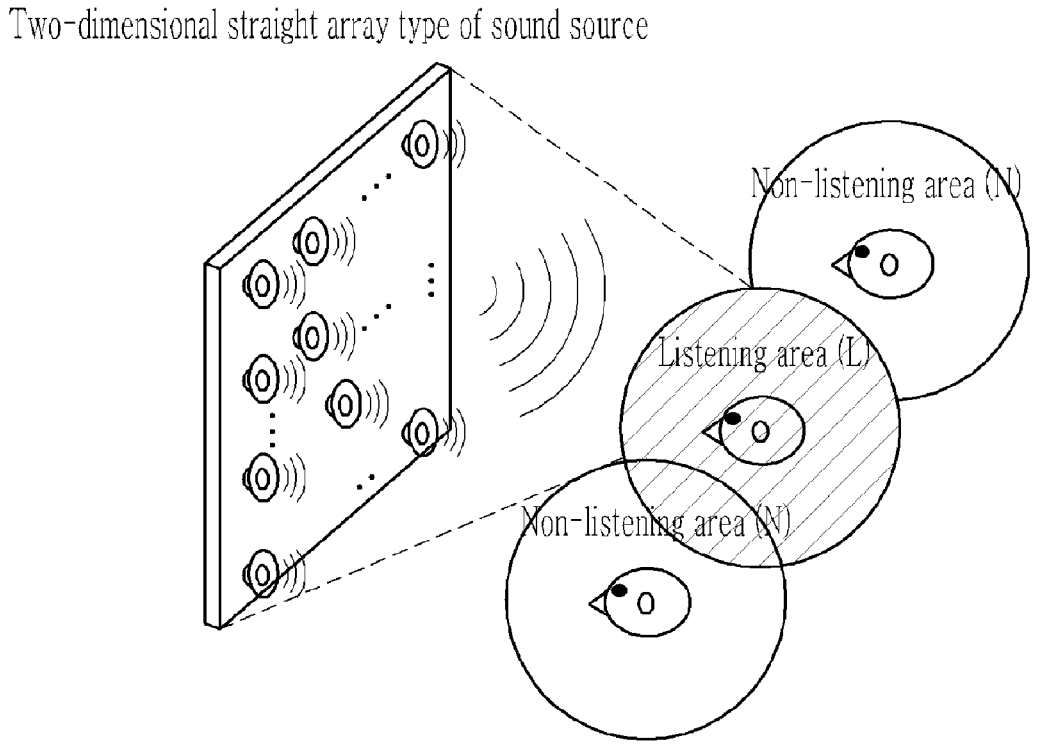
Figure 8:
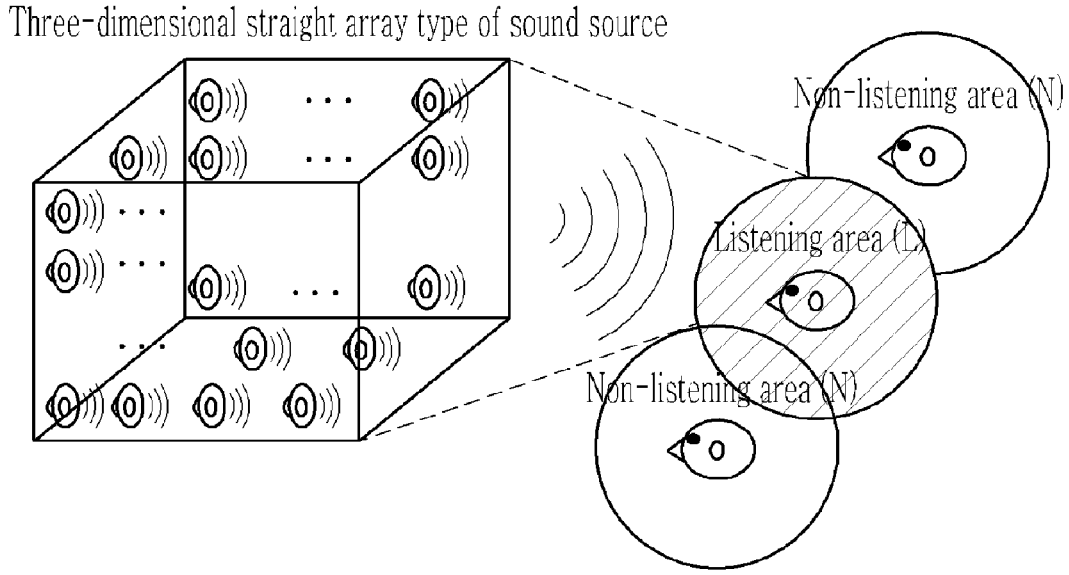

FIGS. 3 and 4 illustrate a method for controlling the sound pressure and phase of each sound source in a frequency domain and a time domain using the optimal sound-source vector.

Referring to FIG. 3, first, a broadband sound source signal in a frequency domain from a frequency converter is input to respective frequency band dividers, in which the broadband sound source signal is divided into several frequency bands. The sound pressure and phase of the sound source signal in each frequency band are adjusted depending on the optimal sound-source vector by each sound pressure and phase controller for a frequency domain. The resultant sound source signals are then converted into those in a time domain by a time domain converter, mixed into one signal, and output via each transducer.

Referring to FIG. 4, the sound pressure and phase of a broadband sound source signal in several frequency bands from a narrow band pass filter are adjusted by delay elements and volume adjusters in each sound pressure and phase controller for a time domain. In this case, the sound pressure and phase adjusted by the delay elements and the volume adjusters are determined depending on the optimal sound-source vector. The resultant sound source signals are then mixed into one signal and output via each transducer.

Figure 9:
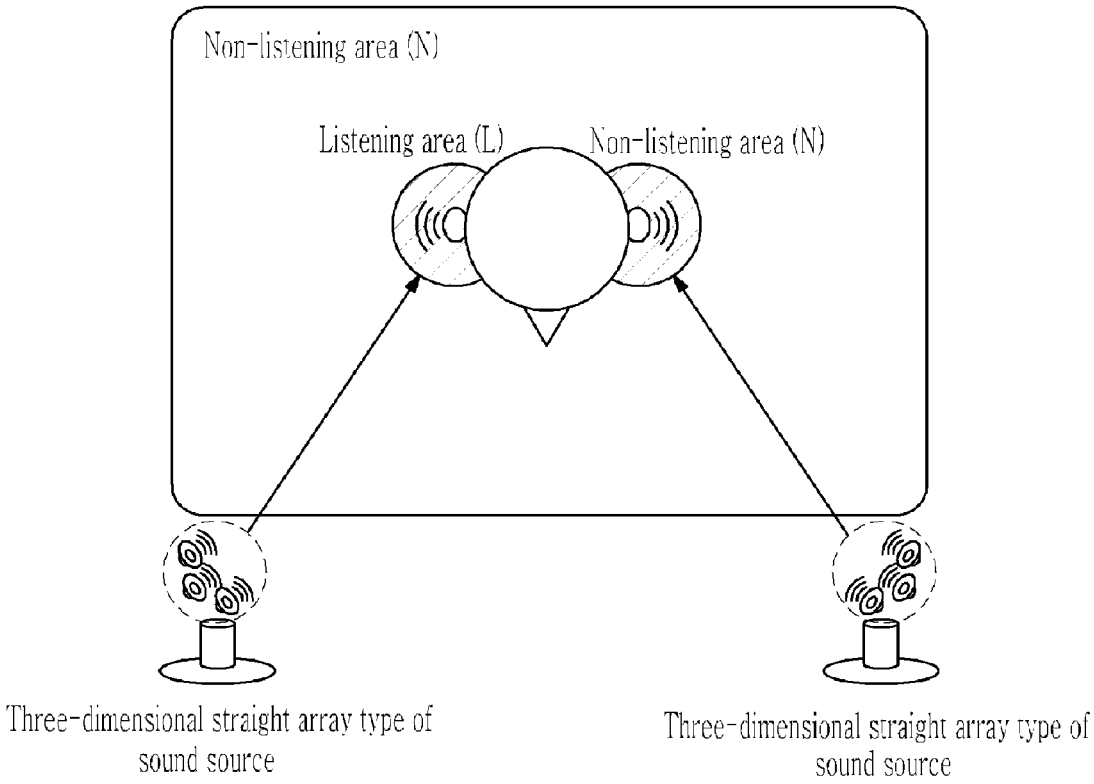
FIG. 9 illustrates an example of implementing a personal sound system using a three-dimensional array type of sound source.

FIGS. 5 through 8 illustrate control of a one-dimensional straight array type of sound source, a one-dimensional curve array type of sound source, a two-dimensional array type of sound source, and a three-dimensional array type of sound source according to a directional sound source control method of the present invention, and FIG. 9 illustrates an example of implementing a personal sound system using a three-dimensional array type of sound source.

As shown in FIGS. 5 to 8, sound is output only in the listening area L where a listener is located by controlling the sound pressure and phase of each sound source depending on the optimal sound-source vector for maximizing the target function $\gamma_\alpha$ irrespective of the type of the sound source, thereby implementing a personal sound system while minimizing auditory disturbance to third parties.

In particular, sound is output only in left and right ear areas of the listener by setting only the left and right ear areas of a listener as a listening area L and other areas as a non-listening area N as shown in FIG. 9 and adjusting the sound pressures and phases of two three-dimensional array type sound sources so that the target function $\gamma_\alpha$ has a maximum value. Thus, three-dimensional sound can be provided to the listener in a personal sound system similar to earphones.

Figure 10:
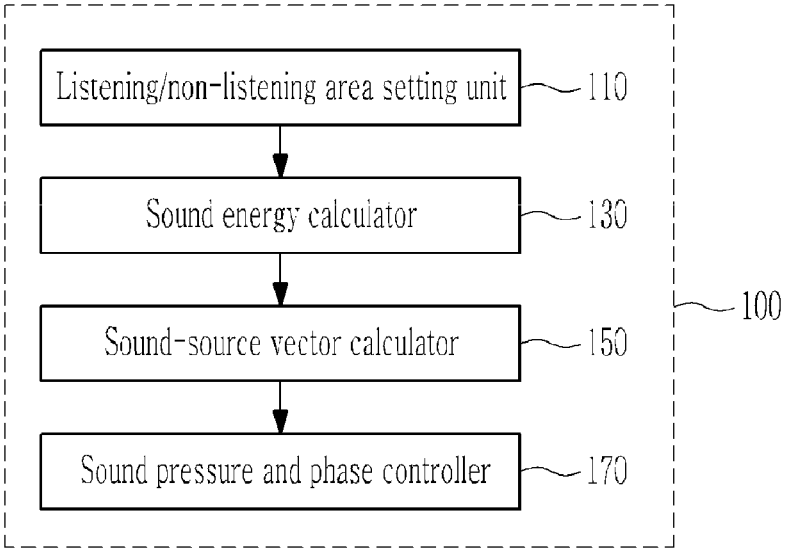
FIG. 10 schematically illustrates an apparatus for controlling directional sound sources according to an exemplary embodiment of the present invention.

FIG. 10 schematically illustrates an apparatus for controlling directional sound sources 100 according to an exemplary embodiment of the present invention.

Referring to FIG. 10, the apparatus for controlling directional sound sources 100 includes a listening/non-listening area setting unit 110, a sound energy calculator 130, a sound-source vector calculator 150, and a sound pressure and phase controller 170.

First, when a listening position of a listener has been determined, the listening/non-listening area setting unit 110 sets the listening area L and the non-listening area N depending on the listening position of the listener. In this case, the listening/non-listening area setting unit 110 also selects the number and positions of sound sources to be used for sound output.

The sound energy calculator 130 then calculates and outputs the sound energies of the listening area L and the non-listening area N and total sound energy of the selected sound sources.

The sound-source vector calculator 150 then calculates and outputs the optimal sound-source vector $S^-$ for maximizing the target function $\gamma_\alpha$, using the values of the sound energies calculated by the sound energy calculator 130. Since the calculation of the optimal sound-source vector $S^-$ has been described with reference to FIGS. 2*a* and 2*b*, it will not be further described.

The sound pressure and phase controller 170 then controls the sound pressure and phase of each sound source depending on the optimal sound-source vector $S^-$.

Sound is heard only in the listening area L and not in the non-listening area N by setting the listening area of the listener as the listening area L and the other areas as the non-listening area N, and then controlling the sound pressure and phase of each sound source depending on the optimal sound-source vector $S^-$, thereby providing personal sound control service for individual use.

According to the present invention, realistic sound can be provided to listeners without causing auditory disturbance to third parties, and maximal sound effects can be obtained with only minimal control.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method for controlling directional sound sources based on a listening area, the method comprising:

setting a listening area for receiving a first level of sound;

setting a non-listening area for receiving a second level of sound lower than the first level of sound;

selecting active sound sources to be used for sound output from among a plurality of sound sources;

calculating a total sound energy of the active sound sources;

calculating a total sound energy of the listening area;

calculating a total sound energy of the non-listening area;

calculating an optimal sound-source vector for minimizing a total sound energy of sound signals input to the active sound sources while maximizing a sound energy difference between the listening area and the non-listening area using values of the total sound energies of the listening area and the non-listening area; and controlling sound pressure and phase of the active sound sources depending on the optimal sound-source vector, wherein the total sound energy $E_L$ of the listening area L and the total sound energy $E_N$ of the non-listening area N are calculated according to the following equations:

$$E_L = \frac{1}{4\rho c^2 V_l}\int_{V_l}(H_k s)^H(H_k s)\,dV = \frac{1}{4\rho c^2}s^H\left(\frac{1}{V_l}\int_{V_l}H_k^H H_k\,dV\right)s = \frac{1}{4\rho c^2}s^H R_L s$$

$$E_N = \frac{1}{4\rho c^2 V_n}\int_{V_n}(G_l s)^H(G_l s)\,dV = \frac{1}{4\rho c^2}s^H\left(\frac{1}{V_n}\int_{V_n}G_l^H G_l\,dV\right)s = \frac{1}{4\rho c^2}s^H R_N s$$

where ρ denotes density of a medium through which sound is propagated, c denotes a propagation speed of the sound, H denotes a Hermitian operator, $V_l$ denotes the volume of the listening area, $V_n$ denotes the volume of the non-listening area, $H_k$ denotes a transfer function between the sound source and the listening area, $G_l$ denotes a transfer function between the sound source and the non-listening area, S denotes a sound-source vector, $R_L$ denotes a correlation of sound pressures formed in the volume of the listening area $V_l$ by different sound sources, and $R_N$ denotes a correlation of sound pressures formed in the volume of the non-listening area $V^n$ by different sound sources.

2. The method of claim 1, wherein the total sound energy of the active sound sources is calculated according to the following equation:

$$S^H S$$

where S denotes a sound-source vector and H denotes a Hermitian operator.

3. The method of claim 2, wherein in calculating the optimal sound-source vector, the optimal sound-source vector is a sound-source vector for maximizing a target function $\gamma_\alpha$ defined by the following equation:

$$\gamma_\alpha = \frac{s^H(R_L - \alpha R_N)s}{s^H s}$$

where S denotes a sound-source vector, H denotes a Hermitian operator, $R_L$ denotes a correlation of sound pressures formed in the volume of the listening area by different sound sources, $R_N$ denotes a correlation of sound pressures formed in the volume of the non-listening area by different sound sources, and a denotes a tuning parameter.

4. The method of claim 3, wherein sound is output only in the listening area by controlling the sound pressure and phase of the active sound sources depending on the optimal sound-source vector for maximizing the target function.

5. The method of claim 1, wherein the plurality of sound sources is configured in a one-dimensional straight array, a one-dimensional curved array, a two-dimensional array, or a three-dimensional array.

6. The method of claim 1, wherein sound is output only in left and right ear areas of the listener by setting the left and right ear areas of the listener as the listening area and adjusting sound pressure and phase of the active sound sources depending on the optimal sound-source vector.

7. An apparatus for controlling directional sound sources based on a listening area, the apparatus comprising:

a listening/non-listening area setting unit configured to set a listening area and a non-listening area and to select active sound sources to be used for sound output from among a plurality of sound sources;

a sound energy calculator configured to calculate a total sound energy of the active sound sources, a total sound energy of the listening area, and a total sound energy of the non-listening area;

a sound-source vector calculator configured to calculate an optimal sound-source vector for minimizing a total sound energy of sound signals input to the active sound sources while maximizing a sound energy difference between the listening area and the non-listening area using the total sound energy of the active sound sources; and a sound pressure and phase controller configured to control sound pressure and phase of the selected sound sources depending on the optimal sound-source vector, wherein the sound energy calculator calculates sound energy $E_L$ of the listening area and sound energy $E_N$ of the non-listening area using the following equations:

$$E_L = \frac{1}{4\rho c^2 V_l}\int_{V_l}(H_k s)^H(H_k s)\,dV = \frac{1}{4\rho c^2}s^H\left(\frac{1}{V_l}\int_{V_l}H_k^H H_k\,dV\right)s = \frac{1}{4\rho c^2}s^H R_L s$$

$$E_N = \frac{1}{4\rho c^2 V_n}\int_{V_n}(G_l s)^H(G_l s)\,dV =$$

-continued $$\frac{1}{4\rho c^2}s^H\left(\frac{1}{V_n}\int_{V_n}G_l^H G_l\,dV\right)s = \frac{1}{4\rho c^2}s^H R_N s$$

where ρ denotes density of a medium through which sound is propagated, c denotes a propagation speed of the sound, H denotes a Hermitian operator, $V_l$ denotes the volume of the listening area, $V_n$ ndenotes the volume of the non-listening area, $H_k$ denotes a transfer function between the sound source and the listening area, $G_l$ denotes a transfer function between the sound source and the non-listening area, S denotes a sound-source vector, $R_L$ denotes a correlation of sound pressures formed in the volume of the listening area $V_l$ by different sound sources, and $R_N$ denotes a correlation of sound pressures formed in the volume of the non-listening area $V_n$ by different sound sources.

8. The apparatus of claim 7, wherein the sound-source vector is a sound-source vector for maximizing a target function $\gamma_\alpha$ defined by the following equation:

$$\gamma_\alpha = \frac{s^H(R_L - \alpha R_N)s}{s^H s}$$

where S denotes a sound-source vector, H denotes a Hermitian operator, $R_L$ denotes a correlation of sound pressures formed in the volume of the listening area by different sound sources, $R_N$ denotes a correlation of sound pressures formed in the volume of the non-listening area by different sound sources, and α denotes a tuning parameter.

* * * * *